US010731312B2

(12) United States Patent
Jarvie

(10) Patent No.: US 10,731,312 B2
(45) Date of Patent: Aug. 4, 2020

(54) SEA WALLS, RETAINING WALLS AND LIKE STRUCTURES USING PIN PILES

(71) Applicant: ARMOUR WALL GROUP PTY LTD, Sutherland (AU)

(72) Inventor: John Jarvie, Cronulla (AU)

(73) Assignee: Armour Wall Group PTY LTD, Sutherland (AU)

( * ) Notice: Subject to any disclaimer, the term of this patent is extended or adjusted under 35 U.S.C. 154(b) by 0 days.

(21) Appl. No.: 15/766,622

(22) PCT Filed: Oct. 12, 2016

(86) PCT No.: PCT/AU2016/000349
§ 371 (c)(1),
(2) Date: Apr. 6, 2018

(87) PCT Pub. No.: WO2017/063021
PCT Pub. Date: Apr. 20, 2017

(65) Prior Publication Data

US 2018/0305884 A1 Oct. 25, 2018

(30) Foreign Application Priority Data

Oct. 13, 2015 (AU) ..... 2015904158

(51) Int. Cl.
*E02D 5/54* (2006.01)
*E02D 5/06* (2006.01)
*E02D 5/03* (2006.01)

(52) U.S. Cl.
CPC ..... *E02D 5/54* (2013.01); *E02D 5/03* (2013.01); *E02D 5/06* (2013.01); *E02D 2200/1685* (2013.01); *E02D 2300/0029* (2013.01); *E02D 2300/0045* (2013.01); *E02D 2600/20* (2013.01); *E02D 2600/30* (2013.01)

(58) Field of Classification Search
CPC .... E02D 5/02; E02D 5/12; E02D 5/54; E02D 29/02; E02D 5/00
USPC ..... 405/274, 284, 285
See application file for complete search history.

(56) References Cited

U.S. PATENT DOCUMENTS 2,101,285 A 12/1937 Stevens
4,863,315 A * 9/1989 Wickberg ..... E02D 5/08 405/278

(Continued)

FOREIGN PATENT DOCUMENTS

CN 1837512 A 9/2006
CN 203639928 U 6/2014

(Continued)

OTHER PUBLICATIONS

ISA, International Search Report and Written Opinion, International Application No. PCT/AU2016/000349, dated Dec. 20, 2016, 11 pages.

*Primary Examiner* — Sean D Andrish
(74) *Attorney, Agent, or Firm* — Foley & Lardner LLP

(57) ABSTRACT

A pin pile is disclosed for anchoring sections of sheet pile to form a wall structure. The pin pile has a casing with a plurality of external clutches formed around the periphery. In use other corresponding clutches on the sections of sheet pile can interlock with the external clutches of the pin pile over a range of angles in accordance with a directional extent of said wall structure.

13 Claims, 5 Drawing Sheets

(56) References Cited

U.S. PATENT DOCUMENTS

| | | | | | |
|---|---|---|---|---|---|
| 5,360,293 | A | * | 11/1994 | Breaux | B09B 1/008 405/267 |
| 7,470,093 | B2 | | 12/2008 | Mansfield | |
| 7,549,823 | B2 | | 6/2009 | Hermes et al. | |

FOREIGN PATENT DOCUMENTS

| | | | | |
|---|---|---|---|---|
| CN | 104271842 | A | | 1/2015 |
| CN | 104631435 | A | | 5/2015 |
| JP | 62291319 | | * | 12/1987 |
| JP | 01146012 | | * | 6/1989 |
| JP | 2001348862 | A | | 12/2001 |
| JP | 200534448 | | * | 12/2005 |
| KR | 2008-0099810 | | | 11/2008 |

* cited by examiner

SEA WALLS, RETAINING WALLS AND LIKE STRUCTURES USING PIN PILES

CROSS REFERENCE TO RELATED APPLICATIONS

This application is a U.S. national stage application under 35 U.S.C. § 371 of PCT Application No. PCT/AU2016/000349 filed on Oct. 12, 2016, which is published in English under PCT Article 21(2) as WO 2017/063021 on Apr. 20, 2017, which in turn claims the benefit and priority to the Australian Patent Application No. 2015904158, filed on Oct. 13, 2015. The entire contents of each of which are incorporated herein in their entirety by reference for all purposes.

FIELD OF THE INVENTION

This invention relates to seawalls, retaining walls and like structures.

BACKGROUND TO THE INVENTION

It is well known to drive prefabricated sheet piles into the ground in interlocking fashion to construct a retaining wall or sea wall behind which loose fill such as soil or sand is placed. In order to stabilize and reinforce this fill it is also known to use tie backs in the form of mesh which extend back from the sheet piles into said fill. This diffuses the outward forces that would otherwise act against the back of the pile by causing the fill to stack vertically as opposed to stacking at its natural shallower angle of repose. One disadvantage of such structures however is that the stacked fill causes a large footprint on the surrounding environment behind the wall. The stacked fill for the tie backs also increases construction costs.

SUMMARY OF THE INVENTION

It is therefore an object of the invention to ameliorate the aforementioned disadvantage and accordingly a pin pile is disclosed for anchoring sections of sheet pile to form a wall structure, said pin pile having a casing with a plurality of external clutches formed around the periphery thereof whereby in use other corresponding clutches on said sections of said sheet pile can interlock with the external clutches of the pin pile over a range of angles in accordance with a directional extent of said wall structure.

Preferably said clutches are formed as one piece with the casing and are coextensive with said casing.

It is further preferred that said clutches comprise pairs of male and/or female clutches which slidably engage other corresponding clutches formed on said sheet piles.

It is further preferred that said clutches are spaced to engage said other corresponding clutches which are formed on the inner and outer side flanges of said sheet piles.

It is further preferred that said female clutches comprise slots formed between curved arms with said slots being shaped and sized for a reasonably close tolerance sliding fit over splayed edges of said male clutches.

BRIEF DESCRIPTION OF THE DRAWINGS

One currently preferred embodiment of the invention will now be described with reference to the attached drawings in which:—

DETAILED DESCRIPTION OF THE PREFERRED EMBODIMENT

Figure 1:
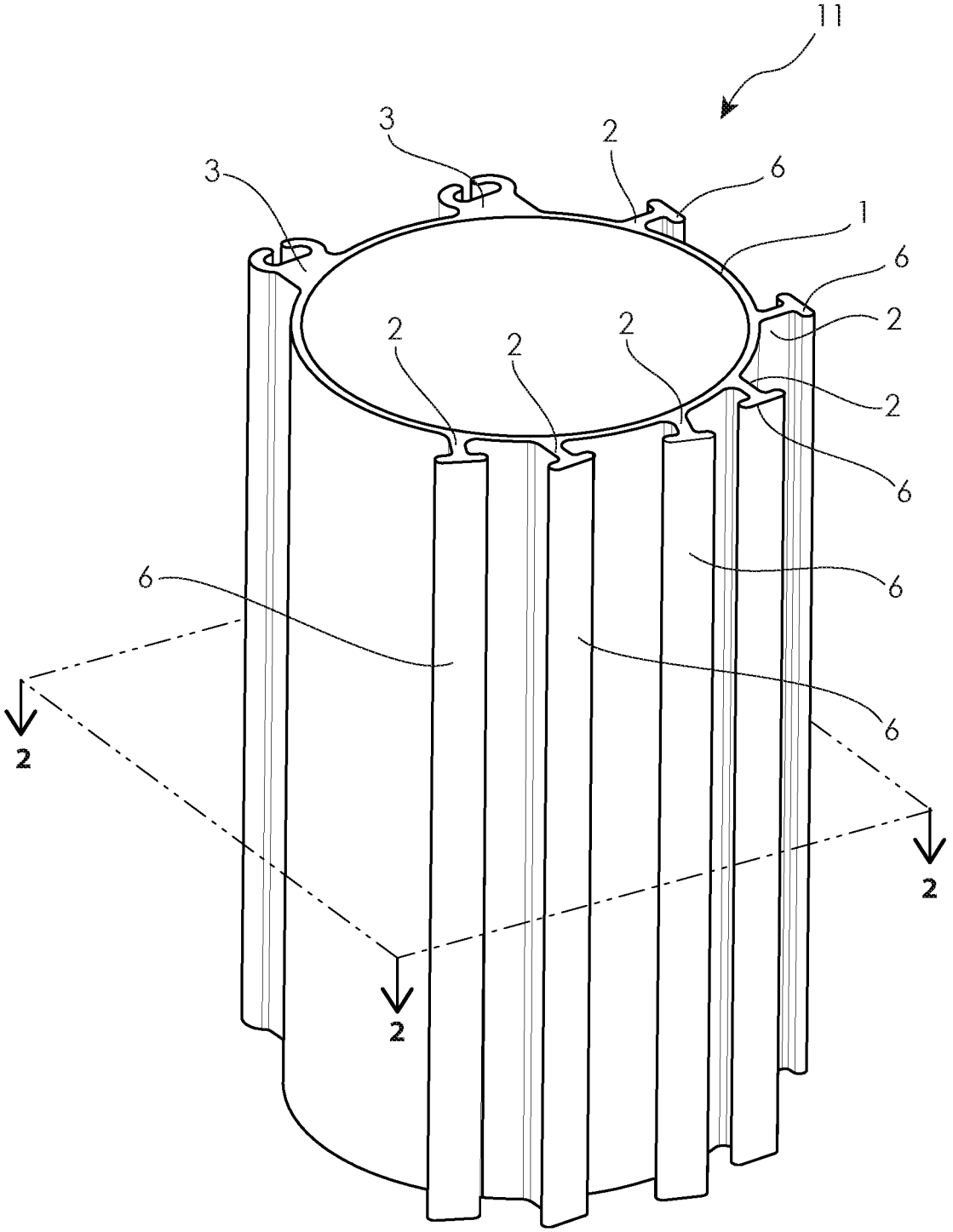
FIG. 1 is a schematic perspective view of a pin pile for constructing a sea wall, retaining wall or like structure in accordance with said invention.
Figure 2:
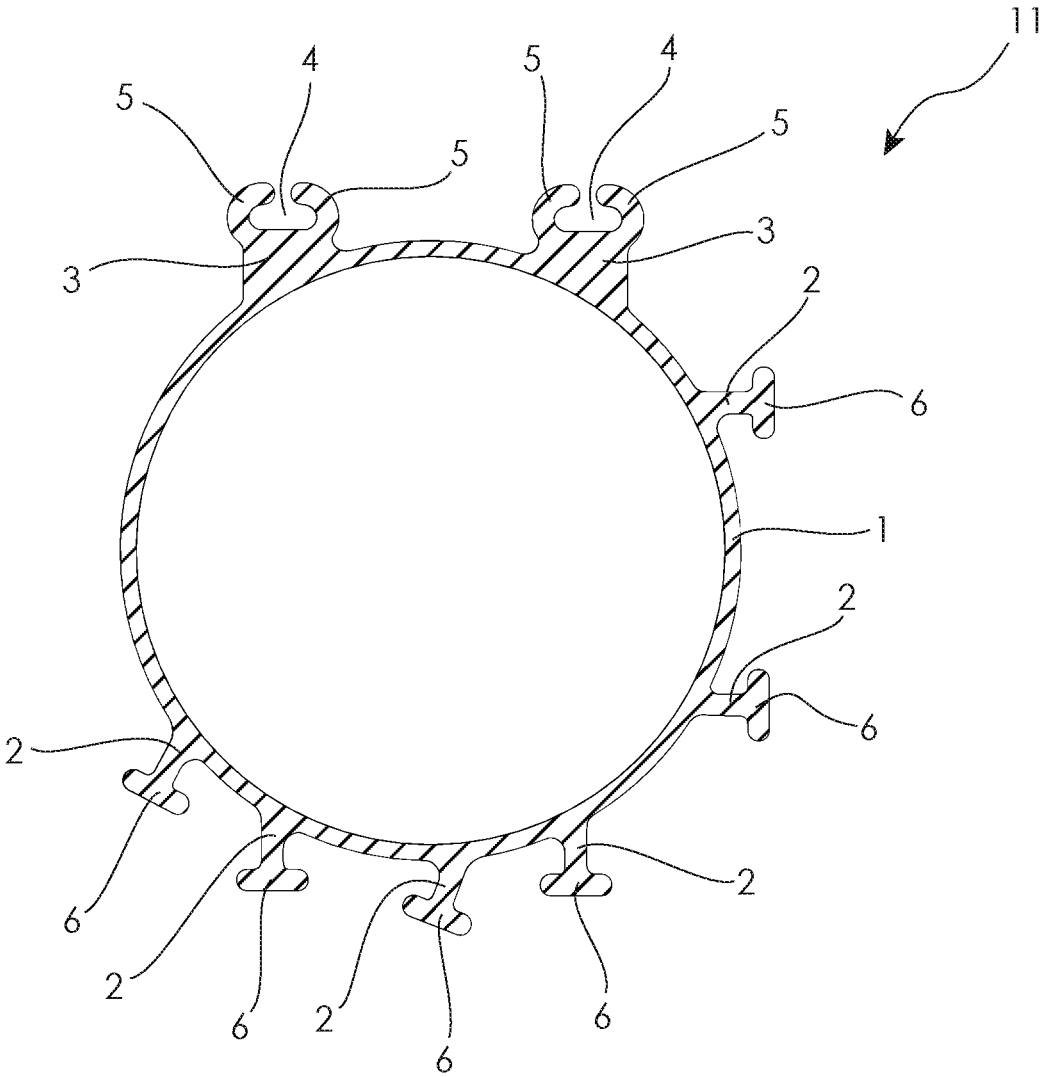
FIG. 2 is an end view of the pin pile of FIG. 1.
Figure 3:
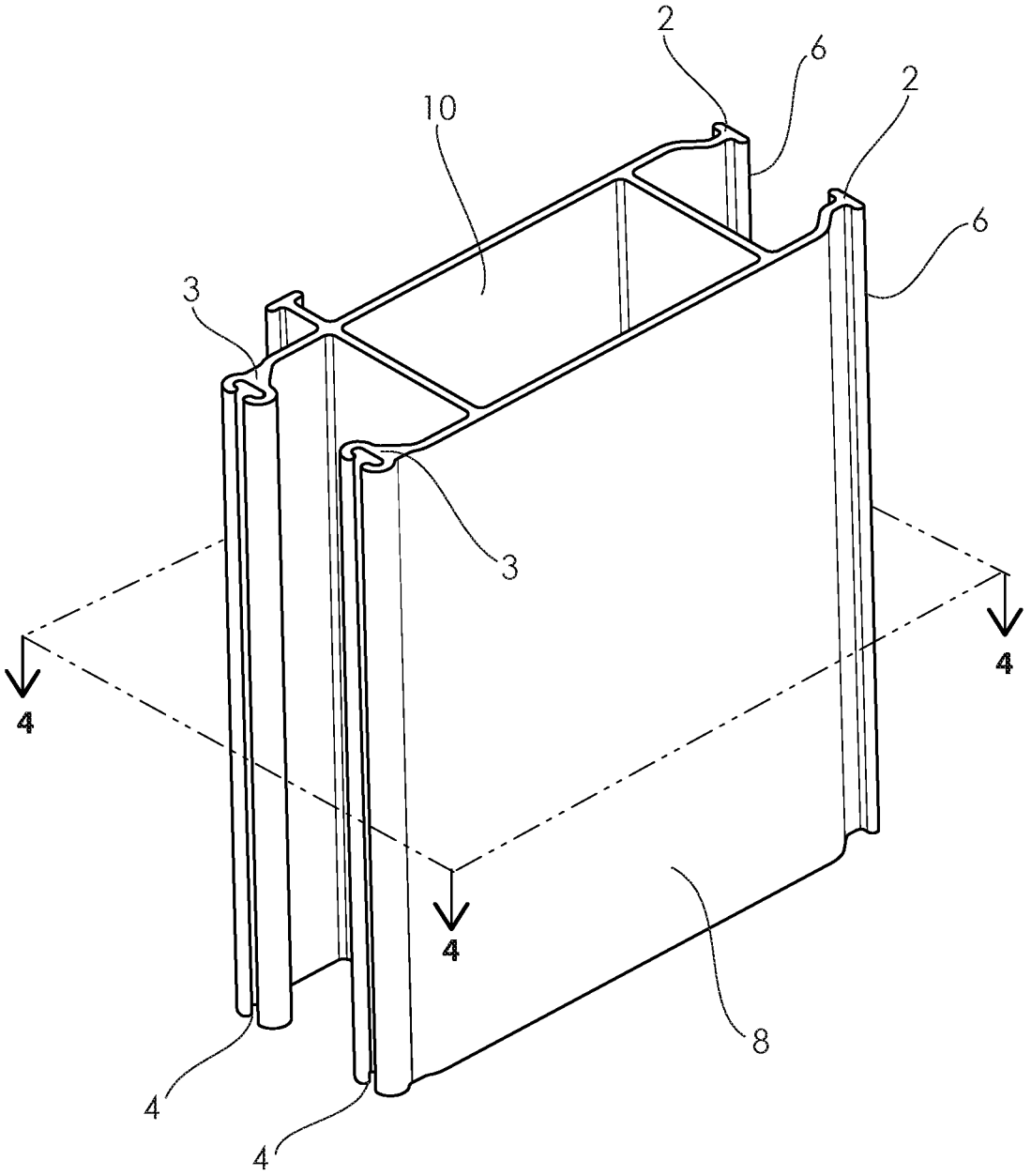
FIG. 3 is schematic perspective view of a sheet pile for use with the pin pile of FIGS. 1 and 2 in constructing said sea wall, retaining wall or like structure in accordance with said invention.
Figure 4:
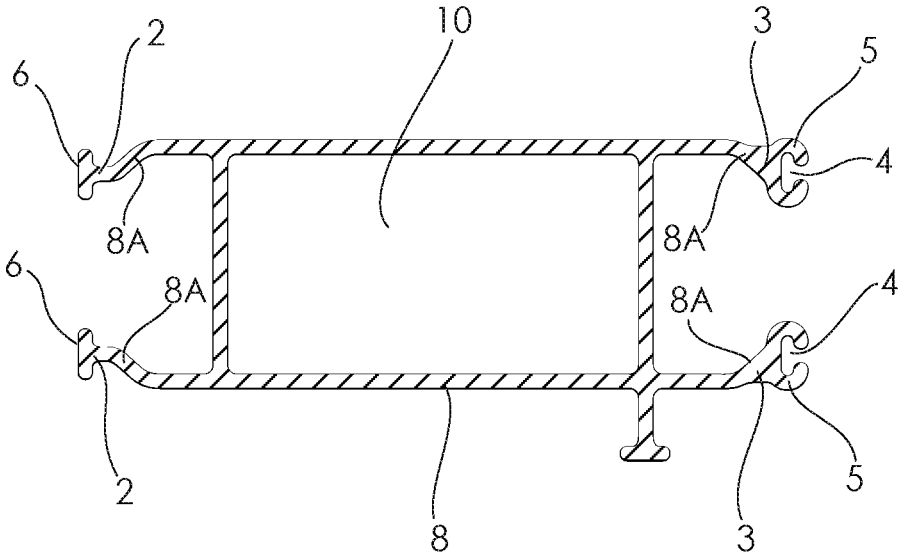
FIG. 4 is a an end view of a sheet pile of FIG. 3.
Figure 5:
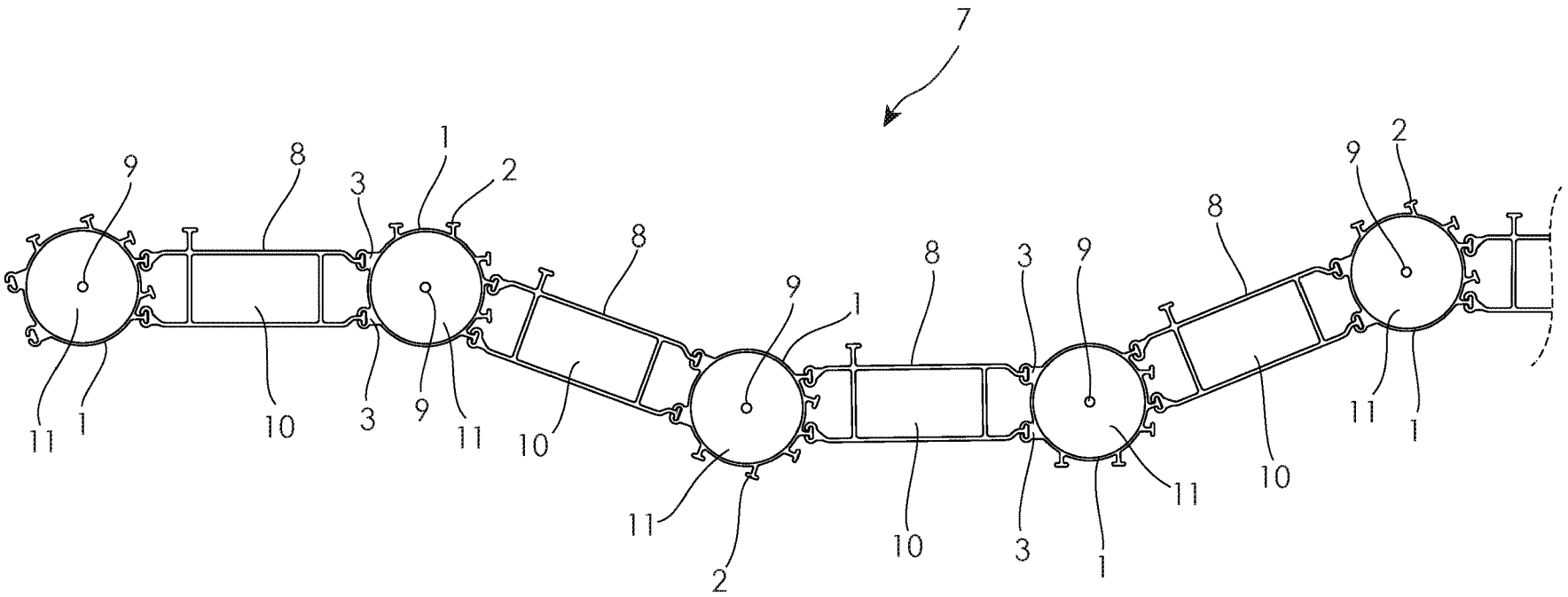
FIG. 5 is a plan view of a section of sea wall constructed using pin piles and sheet piles shown in FIGS. 1 to 4.

Referring first to FIGS. 1 and 2 the pin pile 11 may comprise a hollow fibre reinforced polymer casing 1 of diameter 300 mm and may be of constant cross-section and indeterminate length depending upon installation requirements. It would be installed typically but not exclusively by driving into soil or fill with an appropriate pile driver. In accordance with the invention a series of external male and female clutches 2, 3 are formed around the periphery of the casing. Other corresponding clutches 2, 3 are also formed on the side flanges of the sheet pile 8. With the pin pile 11 the clutches 2, 3 extend the full length of the casing 1. As best shown in FIGS. 2, 3 and 4 the female slots 4 defined within the curved arms 5 of the pin pile clutches 2, 3 and the sheet pile clutches 2, 3 are shaped and sized in cross-section for a reasonably close tolerance sliding fit over the enlarged splayed edges 6 of corresponding male clutches 2 formed on said piles 11, 8. By virtue of said clutches 2, 3 the pin and sheet piles 11, 8 can be slidably interlocked during installation to form a solid wall structure 7 as shown in FIG. 5. Preferably the pin and sheet piles 11, 8 alternate so that each sheet pile 8 is securely anchored at each end. By using the range of angular positions available around the periphery of the pin pile casing 1 for the clutch connections the wall is readily adapted for installation in curved or angled sections according to terrain requirements. The inward angle of the flanges 8A on which the sheet pile clutches 2, 3 are formed also sets them into the wall structure 7 to protect from damage and provide a protrusion free surface for the wall. Mesh tie backs as normally required with prior art wall structures are avoided by the additional installation of anchor pins 9 (which with this embodiment may comprise rail tracks) driven down through the centres of the pin pile casings 1 into the soil or fill below. In accordance with known practice the interior box sections 10 of the sheet piles and the casings 1 of the pin piles 11 are then infilled with cement or grout to substantially anchor the structure without the requirement of mesh tie backs.

It will thus be appreciated that this invention at least in the form of the embodiment described discloses a novel and improved pin pile for constructing sea walls or the like. Clearly however the example described is only the currently preferred form of the invention and a wide variety of modifications may be made without departing from the scope of the invention. For example while the piles are preferably constructed from a fibre reinforced polymer the invention is not limited to this and any other suitable material such as structural steel may be used. Also the configuration and placement of the clutches on the pin and sheet piles may be changed according to installation requirements or design preference.

The invention claimed is:

1. A wall structure comprising:

a pin pile having a casing, said casing comprising at least two male and at least two female clutches, the clutches being formed as one piece of fibre-reinforced polymer with said casing and around a periphery thereof, two of said at least two male clutches forming a pair of male clutches and two of said at least two female clutches forming a pair of female clutches, wherein each male clutch of said pair of male clutches extends from a flange extending from the casing of the pin pile in the same direction as each other and where each female clutch of said pair of female clutches extends from a flange extending from the casing of the pin pile in the same direction as each other, said pin pile being configured to slideably interlock with at least two sheet piles, a first sheet pile at a first periphery of said pin pile and a second sheet pile at a second periphery of said pin pile, said at least two sheet piles each comprising two or more male and two or more female clutches, whereby said two or more female clutches of the first sheet pile are configured to slidably interlock with said pair of male clutches of the pin pile at said first periphery of said pin pile and whereby said two or more male clutches of the second sheet pile are configured to slidably interlock with said pair of female clutches of the pin pile at said second periphery of said pin pile to form said wall structure.

2. The wall structure as claimed in claim 1 wherein said at least two male clutches include multiple pairs of male clutches, each of said multiple pairs configured to slidably engage with a corresponding pair of female clutches on respective adjacent sheets or pin piles.

3. The wall structure as claimed in claim 1 wherein said at least two male clutches are spaced to engage a corresponding at least two female clutches which are formed on inner and outer flanges of an adjacent one of said at least two sheet piles, and wherein said at least two female clutches are spaced to engage a corresponding at least two male clutches which are formed on inner and outer flanges of an adjacent one of said at least two sheet piles.

4. The wall structure as claimed in claim 1 wherein each of said at least two female clutches comprises slots formed between curved arms, said slots being shaped and sized for a sliding fit over splayed edges of corresponding male clutches.

5. The wall structure as claimed in claim 1 wherein each of said at least two male clutches or at least two female clutches extend for the length of the casing.

6. The wall structure as claimed in claim 1 wherein an additional anchor pin is driven down through a centre of the pin pile casing.

7. The wall structure as claimed in claim 6 wherein said casing is arranged to be infilled with cement or grout in use.

8. The wall structure as claimed in claim 1 wherein said casing is arranged to be infilled with cement or grout in use.

9. The wall structure as claimed in claim 1 wherein each of said at least two male or at least two female clutches extend for the length of a respective one of said at least two sheet piles.

10. The wall structure as claimed in claim 1 wherein each of said at least two sheet piles are a box section.

11. The wall structure as claimed in claim 1 wherein each of said at least two female clutches extend for the length of a first sheet pile, and wherein said at least two male clutches extend for the length of an adjacent and corresponding second sheet pile or a pin pile.

12. The wall structure as claimed in claim 11 wherein said first and second sheet piles are each a box section.

13. A wall structure comprising:

a plurality of pin piles, each pin pile in said plurality of pin piles having a casing, said casing comprising at least two male and at least two female clutches, the clutches being formed as one piece of fibre-reinforced polymer with said casing and around a periphery thereof, two of said at least two male clutches forming a pair of male clutches and two of said at least two female clutches forming a pair of female clutches, wherein each male clutch of said pair of male clutches extends from a flange extending from the casing of said each pin pile in the same direction as each other and wherein each female clutch of said pair of female clutches extends from a flange extending from the casing of the pin pile in the same direction as each other, each of said pin piles in said plurality of pin piles being configured to slideably interlock with at least two sheet piles, a first sheet pile at a first periphery of said pin pile and a second sheet pile at a second periphery of said pin pile, said at least two sheet piles each comprising two or more male and two or more female clutches, whereby said two or more female clutches of the first sheet pile are configured to slidably interlock with said pair of male clutches.

* * * * *